United States Patent [19]

Onishi

[11] 4,204,489

[45] May 27, 1980

[54] 2-CYCLE ENGINE OF AN ACTIVE THERMOATMOSPHERE COMBUSTION TYPE

[75] Inventor: Sigeru Onishi, Kanazawa, Japan

[73] Assignee: Toyota Jidosha Kogyo Kabushiki Kaisha, Toyota, Japan

[21] Appl. No.: 970,174

[22] Filed: Dec. 18, 1978

[30] Foreign Application Priority Data

Dec. 21, 1977 [JP] Japan ..... 52/152948

[51] Int. Cl.[2] ..... F02B 33/04

[52] U.S. Cl. ..... 123/73 A; 123/73 R; 123/119 F; 123/179 G; 123/179 L

[58] Field of Search ..... 123/73 A, 73 R, 179 G, 123/179 L, 119 F

[56] References Cited

U.S. PATENT DOCUMENTS

| | | | |
|---|---|---|---|
| 2,717,584 | 9/1955 | Upton | 123/73 A |
| 3,472,211 | 10/1969 | Meininger | 123/73 R |
| 3,690,304 | 9/1972 | Schneider et al. | 123/73 A |

*Primary Examiner*—Wendell E. Burns

*Attorney, Agent, or Firm*—Stevens, Davis, Miller & Mosher

[57] ABSTRACT

A 2-cycle engine having a scavenging passage communicating the crank case with the combustion chamber. The scavenging passage comprises a first passage and a second passage. The first passage has a long length and a small cross-sectional area for causing a fresh combustible mixture to flow at a high speed. The second passage has a short length and a large cross-sectional area for causing a fresh combustible mixture to flow at a low speed. In order to easily start the engine, a fuel pump is provided for directly feeding the fuel into the crank case in response to the operation of the choke mechanism when the engine is started.

16 Claims, 11 Drawing Figures

2-CYCLE ENGINE OF AN ACTIVE THERMOATMOSPHERE COMBUSTION TYPE

DESCRIPTION OF THE INVENTION

The present invention relates to a 2-cycle engine of an active thermoatmosphere combustion type.

As a 2-cycle engine capable of considerably reducing the fuel consumption and the amount of harmful components in the exhaust gas and also capable of obtaining the quiet operation of the engine, the inventor has already proposed an active thermoatmosphere combustion type 2-cycle engine. In this 2-cycle engine, the fresh combustible mixture is caused to flow into the combustion chamber at a low speed in such a way that the cross-section of the transfer passage communicating the combustion chamber with the crank room of the engine is restricted at a position near the crank room. In the above-mentioned 2-cycle engine, by causing the fresh combustible mixture to flow into the combustion chamber at a low speed, an active thermoatmosphere is created in the combustion chamber. Then, the active thermoatmosphere continues to be maintained during the compression stroke, and self-ignition of the fresh combustible mixture is caused at the end of the compression stroke.

Generally speaking, in a 2-cycle engine, when an engine is started under a condition wherein the engine is cold, the fuel fed into the crank room can not be fully vaporized. As a result of this, the mixture fed into the combustion chamber becomes excessively lean and, thus, it is difficult to cause the ignition of the mixture in the combustion chamber. Consequently, in order to prevent the mixture fed into the combustion chamber from becoming excessively rich, a conventional 2-cycle engine is provided with a choke mechanism for feeding a rich mixture into the combustion chamber when the engine is started. However, in an active thermoatmosphere combustion 2-cycle engine, since the cross-section of the transfer passage is restricted as mentioned above, the amount of air introduced into the combustion chamber from the crank room is small, as compared with that of air in a conventional 2-cycle engine. Accordingly, the level of the vacuum produced in the intake passage is reduced as compared with that of the vacuum in a conventional 2-cycle engine and, thus, sufficient fuel cannot be fed into the intake passage. Therefore, in an active thermoatmosphere combustion 2-cycle engine, even if the intake passage is choked by a choke mechanism, a rich mixture, which is sufficient to obtain a good ignition, can not be created in the crank case, and, thus, there occurs a problem in that an engine cannot be easily started.

An object of the present invention is to provide an active thermoatmosphere combustion 2-cycle engine which can be easily started.

According to the present invention, there is provided a 2-cycle engine comprising: an engine body having therein a cylinder bore and a crank room which has a bottom wall; a piston reciprocally movable in said cylinder bore, said piston and said cylinder bore defining a combustion chamber; an intake passage having mixture forming means therein for introducing a fresh combustible mixture into said crank room; choke means having a choke valve arranged in said intake passage for feeding a rich mixture into said crank room where the engine is started; a transfer passage communicating said crank room with an inlet port opening into said combustion chamber; restricting means arranged in said transfer passage at a position near said crank room for throttling the mixture stream flowing in said transfer passage; an exhaust passage having an exhaust port opening into said combustion chamber for discharging exhaust gas to the atmosphere, and; fuel feed means operatively connected to said choke mechanism and actuated in response to the operation of said choke mechanism for feeding fuel into said crank room when the engine is started.

The present invention may be more fully understood from the description of preferred embodiments of the invention set forth below, together with the accompanying drawings.

DESCRIPTION OF PREFERRED EMBODIMENTS

Figure 1:
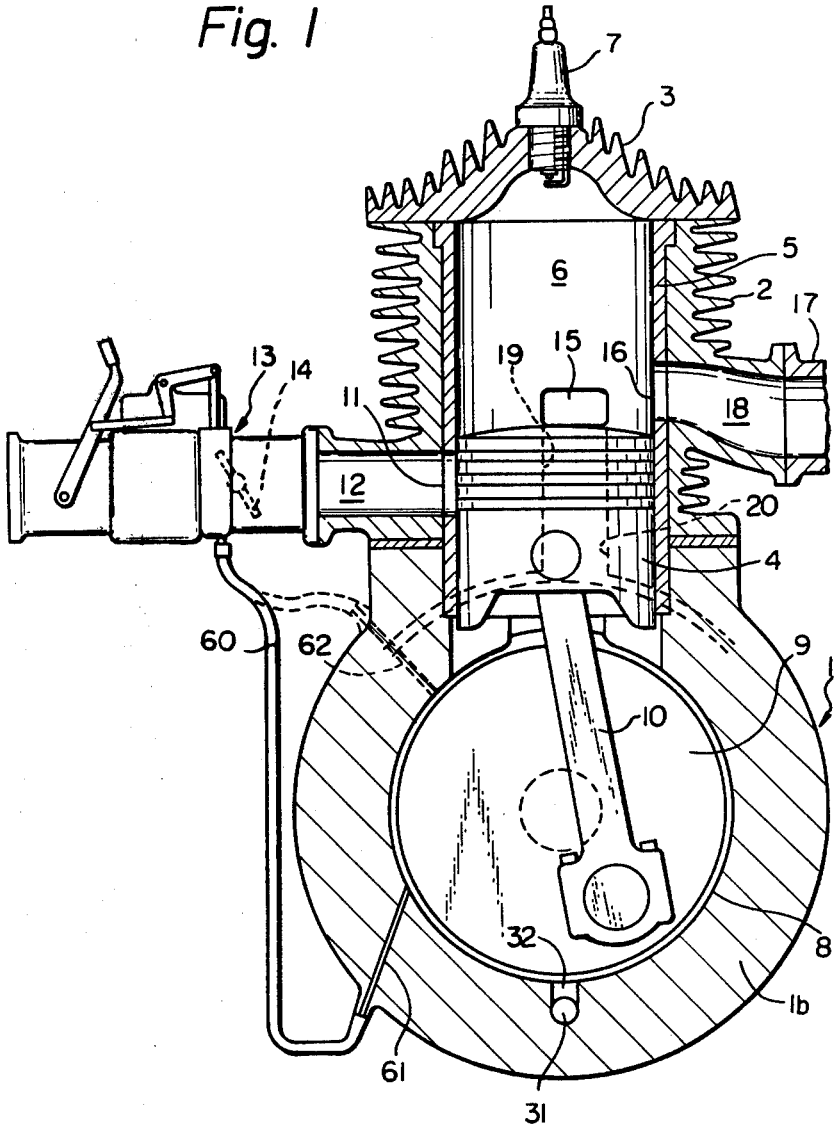
FIG. 1 is a cross-sectional side view of an embodiment of a 2-cycle engine according to the present invention.
Figure 2:
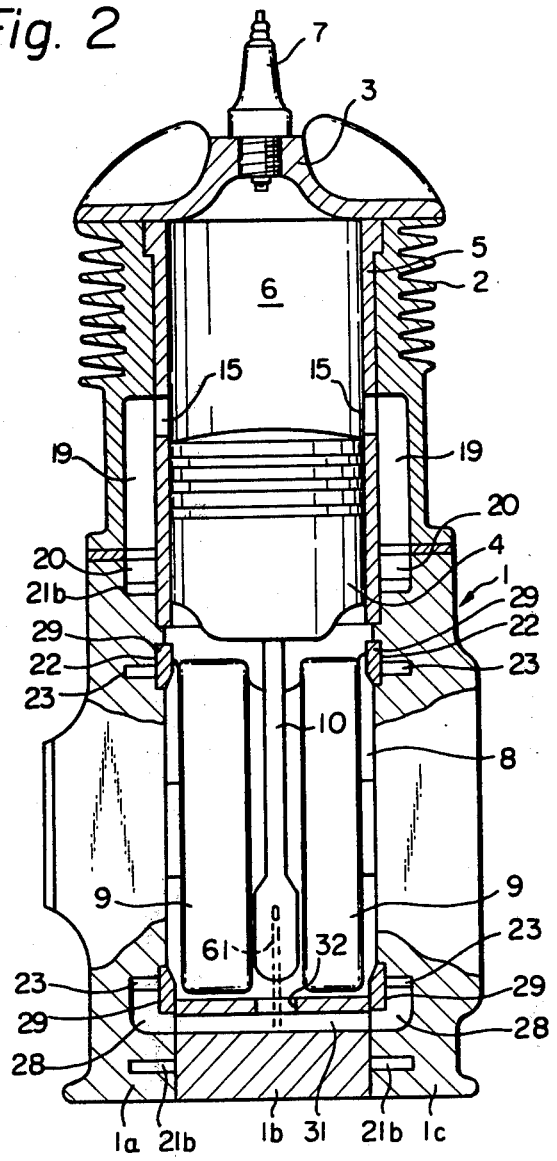
FIG. 2 is a cross-sectional side view of the engine shown in FIG. 1.
Figure 5:
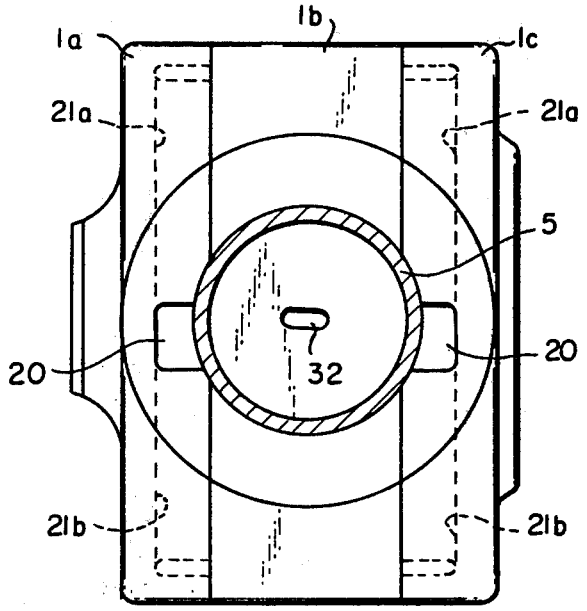
FIG. 5 is a plan view of a crank case.
Figure 6:
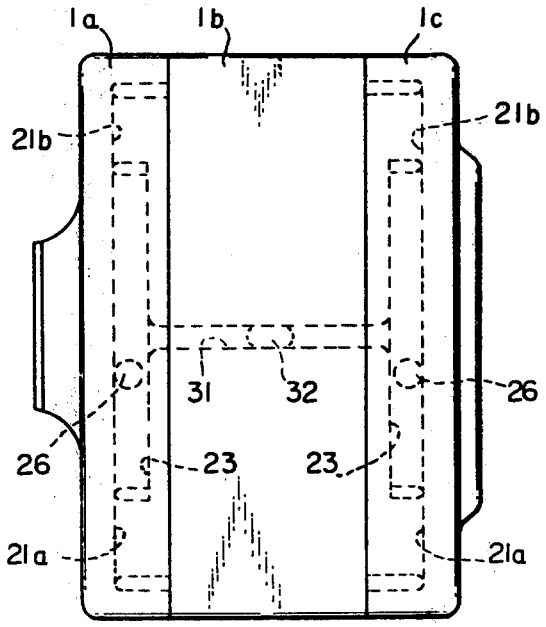
FIG. 6 is a bottom view of a crank case.

Referring to FIGS. 1 and 2, 1 designates a crank case, 2 a cylinder block fixed onto the crank case, 3 a cylinder head fixed onto the cylinder block 2, 4 a piston having an approximately flat top face and reciprocally moving in a cylinder liner 5 fitted into the cylinder block 2 and 6 a combustion chamber formed between the cylinder head 3 and the piston 4; 7 designates a spark plug arranged on the apex of the combustion chamber 6; 8 designates a crank room formed in the crank case 1 and 9 a balance weight; 10 designates a connecting rod, 11 an intake port formed in the cylinder liner 5; 12 designates an intake passage and 13 a carburetor; 14 designates a throttle valve of the carburetor 13, 15 a pair of inlet ports formed in the cylinder liner 5; 16 designates an exhaust port formed in the cylinder liner 5; 17 designates an exhaust pipe, and 18 an exhaust passage. The embodiment illustrated in FIGS. 1 and 2 has a Schnurle type 2-cycle engine having an effective compression ratio of 6.5:1. As illustrated in FIGS. 2, 5, and 6, the crank case 1 comprises three crank case parts 1*a*, 1*b* and 1*c*. A pair of transfer passages 19, each of which opens into the combustion chamber 6 at the inlet port 15 and vertically extends along the outer wall of the cylinder liner 5, is formed in the cylinder block 2, and the transfer passages 19 are connected to corresponding transfer passages 20, each of which is formed on the upper portion of the crank case 1 and aligned with the respective transfer passage 19. The transfer passage consisting of the transfer passages 20 and 21 is hereinafter referred to as a second transfer passage.

Figure 3:
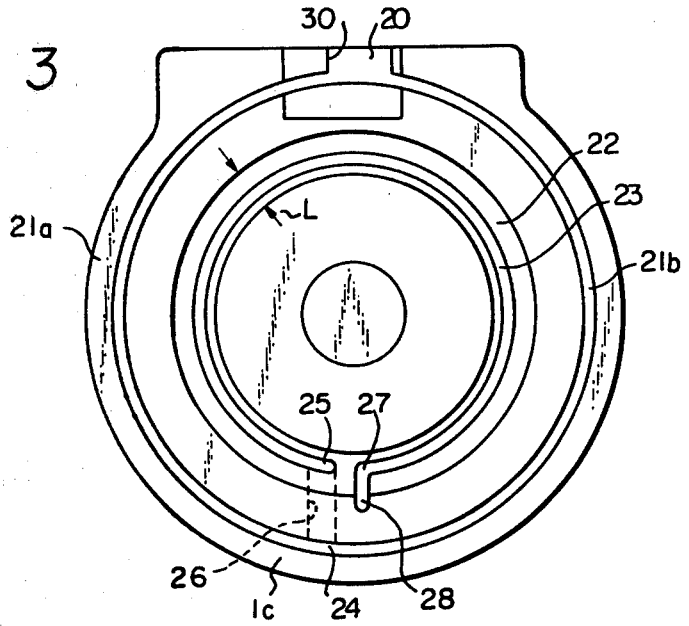
FIG. 3 is a front view of the crank case part 1*c;*
Figure 4:
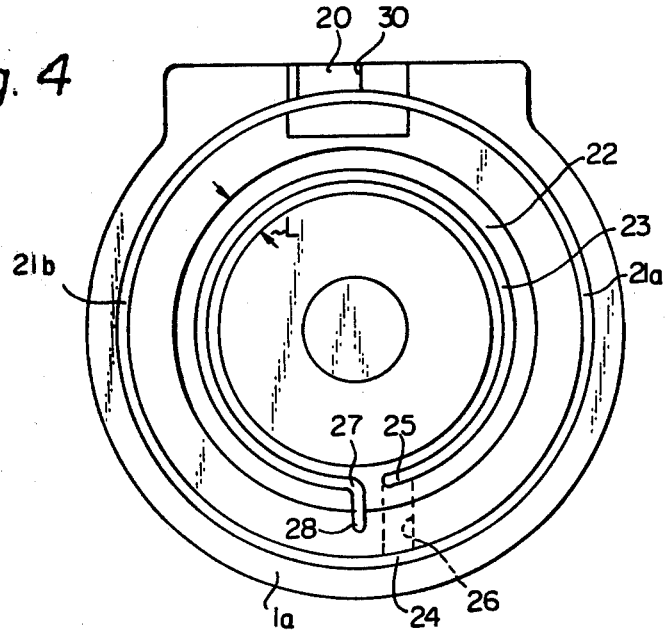
FIG. 4 is a front view of the crank case part 1*a;*

FIG. 3 illustrates the inner wall of the crank case part 1c, and FIG. 4 illustrates the inner wall of the crank case part 1a. Referring to FIGS. 3 and 4, a pair of grooves 21a and 21b is formed on the inner wall of the crank case part 1a, 1c and arranged to extend along the circular periphery thereof. A shallow annular groove 22, having a fixed width L, is formed on the inner wall of the crank case part 1a, 1c at a position located inward of the grooves 21a and 21b, and in addition, a groove 23 extending along the annular groove 22 is formed on the central portion of the bottom face of the annular groove 22. The grooves 21a and 21b are joined to each other at the lowest portion 24 thereof. One end 25 of the groove 23 is in communication with the lowest portion 24 of the grooves 21a and 21b via a hole 26 formed in the crank case part 1a, 1c, while the other end 27 of the groove 23 is connected to a short vertical groove 28 extending downwardly. As is illustrated in FIG. 2, annular plates 29 are fitted into the annular grooves 22 and urged onto the crank case parts 1a, 1c by the crank case part 1b when the crank case parts 1a, 1b and 1c are assembled to form the crank case 1, as illustrated in FIG. 2. Consequently, from FIGS. 2, 3 and 4, it will be understood that, when the crank case parts 1a, 1b and 1c are assembled to form the crank case 1, each of the grooves 21a, 21b, 23 and 28 forms a passage. In addition, from FIGS. 2 and 6, it will also be understood that the depth of the grooves 21a, 21b is deeper than that of the groove 23. As is illustrated in FIGS. 3 and 4, a groove 30 defining the transfer passage 20 and having a depth which is approximately equal to that of the groove 21a, 21b is formed on the upper end portion of the inner wall of the crank case part 1a, 1c, and each of the grooves 21a and 21b opens into the bottom of the groove 30. As is illustrated in FIGS. 1 and 2, a transverse hole 31 is formed in the lower end portion of the crank case part 1b and arranged to align with each of the vertical short grooves 28 which are formed on the inner walls of the respective crank case parts 1a, 1c. This transverse hole 31 is connected to the crank room 8 via a vertical hole 32 which is formed on the bottom wall of the crank room 8.

As will be understood from the above description, each of the transfer passages 20 is connected to the crank room 8 via the grooves 21a, 21b, the hole 26, the groove 23, 28, the transverse hole 31 and the vertical hole 32. The passage consisting of the grooves 21a, 21b, the hole 26, the groove 23, 28, the transverse hole 31 and the vertical hole 32 is hereinafter referred to as a first transfer passage. Consequently, It will be understood that the crank room 8 is connected to the combustion chamber 6 via the above-mentioned first transfer passage and the second transfer passage mentioned previously.

Figure 7:
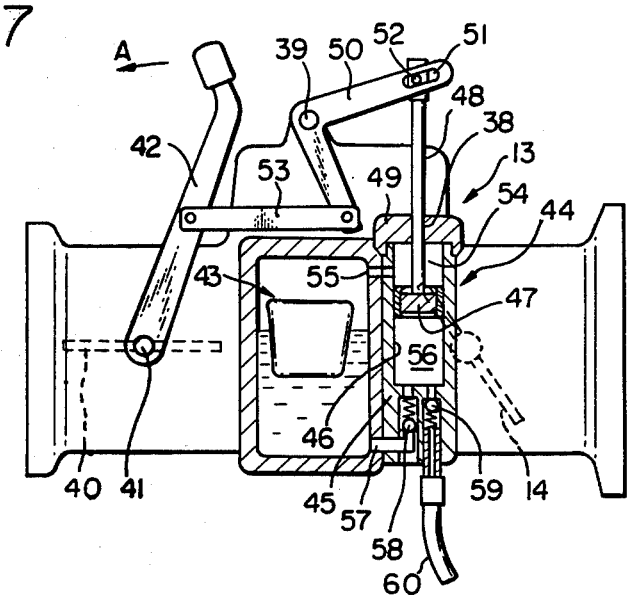
FIG. 7 is a side view, partly in cross-section, of an embodiment of the carburetor shown in FIG. 1.

FIG. 7 is an enlarged side view, partly in cross-section, of the carburetor 13 illustrated in FIG. 1. Referring to FIG. 7, reference numeral 40 designates a choke valve, 41 a choke valve shaft, 42 a choke lever, 43 a float chamber, and 44 a fuel pump. The fuel pump 44 comprises a cylinder bore 46 formed in the pump housing 45, and a piston 47 sealingly and reciprocably movable in the cylinder bore 46. A piston rod 48 fixed onto the piston 47 passes through a guide hole 38 formed on a seal cap 49 and projects upwards from the cap 49. A lever 50 is pivotally mounted on the housing of the carburetor 13 by means of a pivot pin 39, and a pin 52 fixed onto the tip of the piston rod 48 is fitted into a slot 51 which is formed on one end of the lever 50. The other end of the lever 50 is connected to the choke lever 42 via a link 53.

When the engine is started, the choke lever 42 is manually rotated in the direction A in FIG. 7. As a result of this, the choke valve 40 is closed and, at the same time, the lever 50 is caused to rotate in the clockwise direction, whereby the piston 47 moves downwards. An upper chamber 54 of the fuel pump 44 is in communication with an upper space within the float chamber 43 via a hole 55 and, on the other hand, a lower chamber 56 of the fuel pump 44 is connected to the float chamber 43 via a fuel passage 57. A check valve 58, which only allows the inflow of fuel into the lower chamber 56 from the float chamber 43, is arranged in the fuel passage 57. In addition, the lower chamber 56 is connected to a fuel conduit 60 via a check valve 59, which only allows the outflow of fuel from the lower chamber 56 to the fuel conduit 60. As is illustrated in FIGS. 1 and 2, the fuel conduit 60 is connected to a fuel injection hole 61, which is formed in the crank case part 1b. This fuel injection hole 61 is so arranged that the fuel injected from the injection hole 61 passes between a pair of the balance weights 9 and, then, impinges upon the bottom face of the piston 4. Consequently, when the choke lever 42 is rotated in the direction A in FIG. 7 for starting the engine, the piston 47 moves downwards. As a result of this, the fuel in the lower chamber 56 is injected from the injection hole 61 towards the bottom face of the piston 4 via the check valve 59 and the fuel conduit 60. The fuel injected from the injection hole 61, and containing lubricating oil therein, impinges upon the bottom face of the piston 4 and spreads in the crank room 8. As a result of this, the fuel thus spread forms a rich mixture in the crank room 8 and, at the same time, lubricates the cylinder liner 5, the piston pin and the crank pin. Consequently, when the crank shaft of the engine is rotated manually or by a starting motor for starting the engine, since the rich mixture is fed into the combustion chamber 6 via the first transfer passage and the second transfer passage, the engine is easily started. When the operation of the engine is started, since the choke lever 42 manually rotates in the direction opposite to the direction A, the choke valve 40 is opened and, at the same time, the piston 47 is caused to move upwards. As a result of this, the fuel in the float chamber 43 is fed into the lower chamber 56 via the fuel conduit 57 and the check valve 58.

When the operation of the engine is started, the fresh combustible mixture introduced into the crank room 8 from the intake port 11 is gradually compressed in accordance with the downward movement of the piston 4 and, thus, the fresh combustible mixture is forced into the transverse hole 31 via the vertical hole 32. Then, the fresh combustible mixture flows into the grooves 21a, 21b via the vertical groove 28, the groove 23 and the hole 26. As will be understood from FIGS. 1 and 6, since the groove 23 has an extremely small cross-sectional area, the fresh combustible mixture flows at a high speed in the groove 23 and then flows into the grooves 21a, 21b. As is mentioned above, the fresh combustible mixture is caused to flow at a high speed in the groove 23, the flow energy is added to the fresh combustible mixture and, as a result, the vaporization of the liquid fuel continues to be promoted during this time. Then the fresh combustible mixture flows into the grooves 21*a* and 21*b*. As will be understood from FIGS. 1 and 6, since the cross-sectional area of the groove 21*a*, 21*b* is larger than that of the passage 23 and, in addition, the fresh combustible mixture flowing out from the passage 23 is branched off into two streams, the flow velocity of the fresh combustible mixture flowing in the passages 21*a* and 21*b* is reduced, as compared with the case wherein the fresh combustible mixture flows in the passage 23. However, the flow velocity of the fresh combustible mixture flowing in the grooves 21*a* and 21*b* is relatively high and, thus, the liquid fuel which has not been vaporized in the groove 23 is sufficiently vaporized in the grooves 21*a* and 21*b*. After the vaporization of the fresh combustible mixture is sufficiently promoted, the fresh combustible mixture in the first transfer passage flows into the second transfer passage. At this time, since the streams of the fresh combustible mixture flowing out from the passages 21*a* and 21*b* come into violent contact with each other in the transfer passage 20 and lose kinetic energy, and in addition, the transfer passage 20 has a cross-sectional area which is considerably larger than those of the passages 21*a* and 21*b*, the fresh combustible mixture flowing into the transfer passage 20 from the passages 21*a* and 21*b*, is abruptly decelerated. After this, the fresh combustible mixture moves upward at a low speed in the transfer passages 20 and 19, and then, flows into the combustion chamber 6 at a low speed when the piston 4 opens the inlet ports 15. Even if the pressure in the crank room 8 is considerably higher than that in the combustion chamber 6 when the piston 4 opens the inlet ports 15 to permit the inflow of the fresh combustible mixture into the combustion chamber 6, since the passage 23 functions as throttling means because it has a small cross-sectional area, the fresh combustible mixture can not flow into the combustion chamber 6 at a high speed. As a result of this, the flow velocity of the fresh combustible mixture is low throughout the inflow operation of the fresh combustible mixture. Consequently, when the fresh combustible mixture flows into the combustion chamber 6, the movement of the residual burned gas in the combustion chamber 6 is extremely small and, as a result, the dissipation of the heat of the residual burned gas is prevented. Thus, the residual burned gas is maintained at a high temperature. In addition, at the beginning of the compression stroke under a partial load of the engine, a large amount of the residual burned gas is present in the combustion chamber 6. Since the amount of the residual burned gas in the combustion chamber 6 is large and, in addition, the residual burned gas has a high temperature, the fresh combustible mixture is heated until radicals are produced and, as a result, an active thermoatmosphere is created in the combustion chamber 6. An atmosphere wherein radicals are produced as mentioned above is hereinafter called an active thermoatmosphere. Since the movement of the gas in the combustion chamber 6 is extremely small during the compression stroke, the occurrence of turbulence and the loss of heat energy escaping into the inner wall of the combustion chamber 6 are restricted to the smallest possible extent. Consequently, the temperature of the gas in the combustion chamber 6 is further increased as the compressing operation progresses and, as a result, the amount of radicals produced in the combustion chamber 6 is further increased. When the radicals are produced, the combustion which is called a preflame reaction has been started. After this, when the temperature of the gas in the combustion chamber 6 becomes high at the end of the compression stroke, a hot flame generates to cause the self ignition which is not caused by the spark plug 7. Then, the gentle combustion is advanced while being controlled by the residual burned gas. When the piston 4 moves downwards and opens the exhaust port 16, the burned fas in the combustion chamber 6 is discharged into the exhaust passage 18.

As is illustrated in FIGS. 1 and 2, the first transfer passage opens on the bottom wall of the crank room 8. When the engine is started, a part of the fuel injected from the injection hole 61 instantaneously falls down and is collected on the bottom wall of the crank room 8. Consequently, when the crank shaft is rotated for starting the engine, the liquid fuel thus collected on the bottom wall of the crank room 8 is instantaneously forced into the first transfer passage. Since the flow energy is added to the liquid fuel forced into the first transfer passage, the vaporization of the liquid fuel is promoted in the first transfer passage. Thus, a rich mixture is formed in the fist transfer passage and, then, the rich mixture thus formed is fed into the combustion chamber 6. Consequently, the engine can be easily started by feeding a small amount of fuel into the crank room 8 from the injection hole 61.

In the embodiment illustrated in FIGS. 1 and 2, the injection hole 61 is so arranged that the fuel is injected towards the bottom face of the piston 4. However, as is illustrated by the broken line in FIG. 1, instead of adopting the arrangement of the injection hole 61, the injection hole 62 may be so arranged that the fuel is injected from the injection hole 62 towards the center of the crank room 8.

Figure 8:
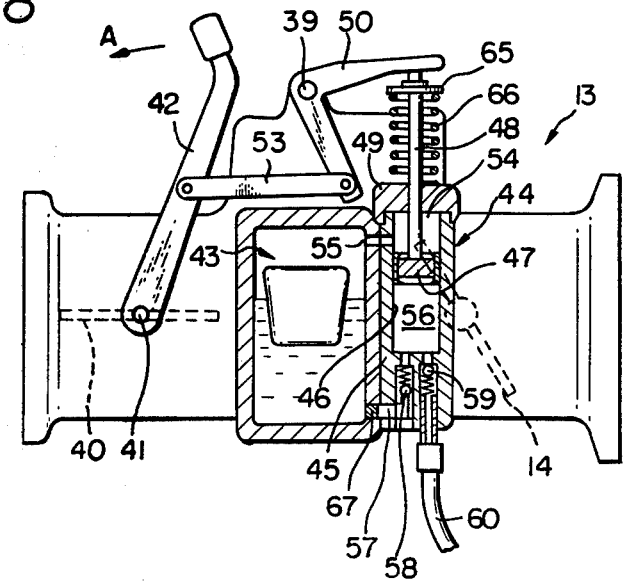
FIG. 8 is a side view, partly in cross-section, of another embodiment according to the present invention.

In the embodiment illustrated in FIG. 7, the operator must manually return the choke valve 40 to its full open position after the engine is started. However, actually, the operator will sometimes forget to return the choke valve 40 to its full open position. Consequently, it is preferable that the choke valve 40 be automatically returned to its full open position. FIG. 8 shows an automatic choke mechanism capable of automatically returning the choke valve 40 to its full open position. Referring to FIG. 8, a compression spring 66 is inserted between the seal cap 49 and a valve seat 65 fixed onto the upper end of the piston rod 48, and the tip of the lever 50 is arranged to be able to abut against the top of the piston rod 48. In addition, a throttling member 67, made of sintered metal, is inserted into the fuel passage 57. In this embodiment, when the choke lever 42 is rotated in the direction A in FIG. 8 for starting the engine, the choke valve 40 is opened and, at the same time, the piston 47 is caused to move downwards. As a result of this, the fuel is injected into the crank room 8 as mentioned previously and, then, the operation of the engine is started. When the choke lever 42 is set free, the upward movement of the piston 47 is started due to the spring force of the compression spring 66 and, thus, the fuel in the float chamber 43 flows into the lower chamber 56 via the check valve 58. However, since the throttling member 67 is arranged in the fuel passage 57, the inflow velocity of the fuel flowing into the lower chamber 56 is low and, thus, the piston 47 gradually moves upwards. As a result of this, the choke valve 40 is gradually opened.

Figure 9:
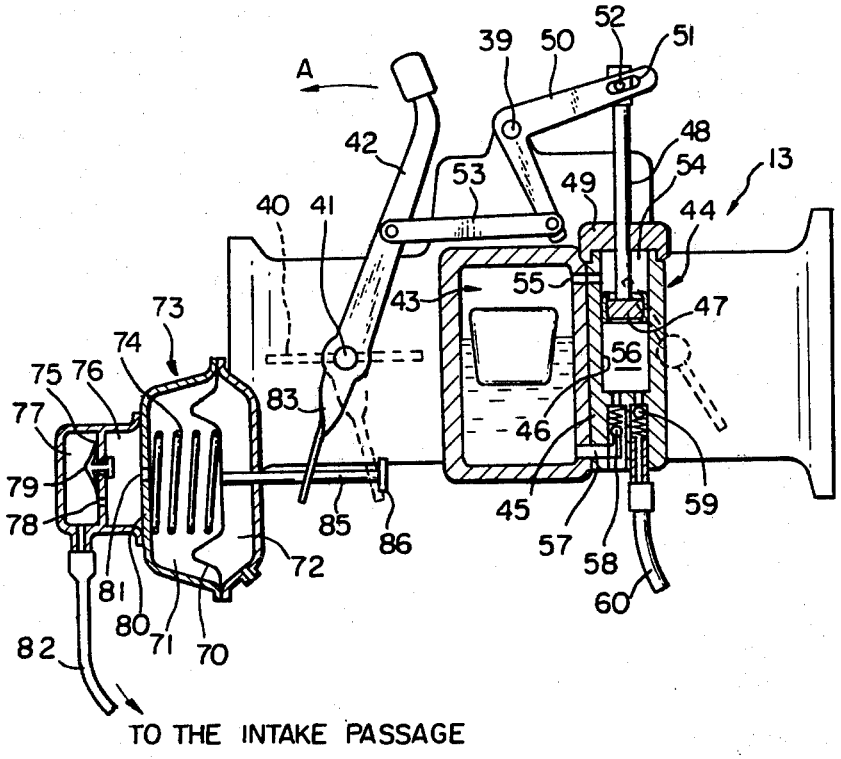
FIG. 9 is a side view, partly in cross-section, of a further embodiment according to the present invention.
Figure 10:
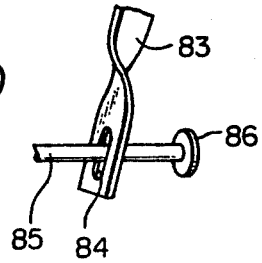
FIG. 10 is a perspective view of the control rod and the choke lever shown in FIG. 9.

FIG. 9 illustrates a further embodiment according to the present invention. Referring to FIG. 9, a diaphragm apparatus 73 is provided which comprises a vacuum chamber 71 and an atmospheric pressure chamber 72, which are separated by a diaphragm 70. A compression spring 74 is arranged in the vacuum chamber 71 so that the diaphragm 70 is always urged towards the right in FIG. 9 due to the spring force of the compression spring 74. A vacuum accumulation chamber 76 and an auxiliary chamber 77, which are separated by a partition 75 and arranged in tandem, are provided on the outside of the vacuum chamber 71. A restricted opening 78 in a check valve 79, allowing the outflow of air from the vacuum accumulation chamber 76 to the auxiliary chamber 77, are arranged on the partition 75. In addition, another restricted opening 81 is formed on a partition 80, which serves to separate the vacuum chamber 71 and the vacuum accumulation chamber 76. The auxiliary chamber 77 is connected via a vacuum conduit 82 to the intake passage 12 (FIG. 1) located downstream of the throttle valve 14. As is illustrated in FIG. 10, the choke lever 42 has an extending portion 83, and a slot 84 is formed in the lower end of the extending portion 83. A control rod 85 fixed to the diaphragm 70 passes through the slot 84 so as to be freely movable in the slot 84. In addition, the control rod 85 has on its tip a stop 86.

Since the pressure in the intake passage 12 (FIG. 1) is equal to the atmospheric pressure before the engine is started, the pressure in the vacuum chamber 71 is also equal to the atmospheric pressure. When the choke lever 42 is rotated in the direction A in FIG. 9 for starting an engine, the choke valve 40 is closed, and the extending portion 83 of the choke lever 42 approaches the stop 86. At the same time, the piston 47 moves downwards, and the fuel is fed into the crank room 8, in the same manner as described with reference to FIG. 1. When the operation of the engine is started, a pulsating vacuum is produced in the intake passage 12 and, thus, the pulsating vacuum is also produced in the auxiliary chamber 77. When the level of vacuum produced in the auxiliary chamber 77 becomes greater than that of the vacuum produced in the vacuum accumulating chamber 76, the check valve 79 opens. On the other hand, when the level of vacuum produced in the auxiliary chamber 77 becomes smaller than that of the vacuum produced in the vacuum accumulation chamber 76, the check valve 79 instantaneously closes. Consequently, when the operation of the engine is started, the level of vacuum in the vacuum accumulating chamber 77 is maintained at a peak vacuum level of the pulsating vacuum produced in the auxiliary chamber 77. On the other hand, since the air in the vacuum chamber 71 gradually flows into the vacuum accumulating chamber 76 via the restricted opening 81, the level of vacuum produced in the vacuum chamber 71 is gradually increased. As a result of this, since the diaphragm 70 gradually moves towards the left in FIG. 9 against the spring force of the compression spring 74 and, accordingly, the choke lever 42 is rotated in the clockwise direction, the choke valve 40 is gradually opened and, at the same time, the piston 47 gradually moves upward. In this embodiment, the choke lever 42 can be freely rotated relative to the control rod 85 in the clockwise direction. Consequently, by manually actuating the choke lever 42, the choke valve 40 can be returned to its full open position before the choke valve 40 is automatically closed by the control rod 85 of the diaphragm apparatus 73.

Figure 11:
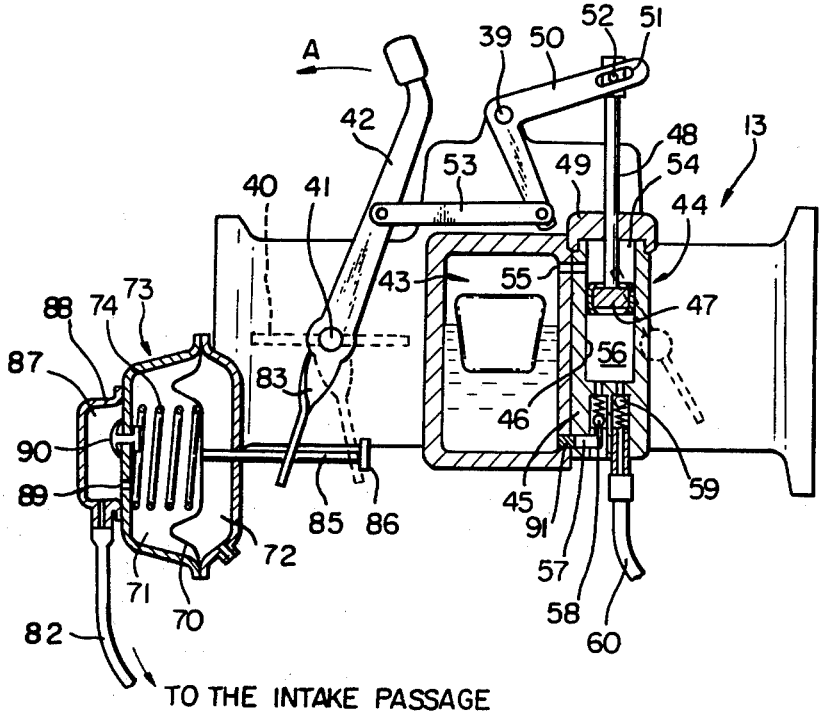
FIG. 11 is a side view, partly in cross-section, of a still further embodiment according to the present invention.

FIG. 11 illustrates a still further embodiment according to the present invention. Referring to FIG. 11, an auxiliary chamber 87 is formed on the outside of the vacuum chamber 71, and a restricted opening 89 and a check valve 90 only allowing the inflow of air from the vacuum chamber 71 to the auxiliary chamber 87 are arranged on a partition 88 which serves to separate the auxiliary chamber 87 and the vacuum chamber 71. In addition, a throttling member 91, made of sintered metal, is inserted in the fuel passage 57. In this embodiment, when the operation of the engine is started, the level of vacuum in the vacuum chamber 71 is maintained at a peak vacuum level of the pulsating vacuum produced in the auxiliary chamber 87, in the same manner as described with reference to FIG. 9. As a result of this, the diaphragm 70 moves toward the left in FIG. 11 and, accordingly, the upward movement of the piston 47 is started because the movement of the diaphragm 70 is transferred to the piston 47 via the choke lever 42, the link 53 and the lever 50. However, at this time, since the throttling member 91 is arranged in the fuel passage 57, the piston 47 cannot rapidly move upward. As a result of this, the choke valve 40 is gradually opened.

According to the present invention, an engine can be easily started by directly feeding the fuel into the crank room in such a way that the fuel pump is actuated in response to the operation of a choke mechanism, which operation is necessary to start an engine.

While the invention has been described by reference to specific embodiments chosen for purposes of illustration, it should be apparent that numerous modifications could be made thereto by those skilled in the art without departing from the spirit and scope of the invention.

What is claimed is:

1. A 2-cycle engine comprising:
   - an engine body having therein a cylinder bore and a crank room which has a bottom wall;
   - a piston reciprocally movable in said cylinder bore, said piston and said cylinder bore defining a combustion chamber;
   - an intake passage having mixture forming means therein for introducing a fresh combustible mixture into said crank room;
   - choke means having a choke valve arranged in said intake passage for feeding a rich mixture into said crank room when the engine is started;
   - a transfer passage communicating said crank room with an inlet port opening into said combustion chamber;
   - restricting means arranged in said transfer passage at a position near said crank room for throttling the mixture stream flowing in said transfer passage;
   - an exhaust passage having an exhaust port opening into said combustion chamber for discharging exhaust gas to the atmosphere, and;
   - fuel feed means operatively connected to said choke mechanism and actuated in response to the operation of said choke mechanism for feeding fuel into said crank room when the engine is started.

2. A 2-cycle engine as claimed in claim 1, wherein said transfer passage comprises at least one first transfer passage portion connected to said crank room, and at least one second transfer passage portion connected to said combustion chamber and having a cross-section which is larger than that of said first transfer passage portion, said restricting means being first transfer passage portion.

3. A 2-cycle engine as claimed in claim 2, wherein the length of said first transfer passage portion is longer than that of said second transfer passage portion.

4. A 2-cycle engine as claimed in claim 2, wherein said first transfer passage portion has an inlet opening which opens into said crank room, said inlet opening being formed on the bottom wall of said crank room.

5. A 2-cycle engine as claimed in claim 2, wherein said first transfer passage portion opens into said second transfer passage portion at a right angle relative to a longitudinal axis of said second transfer passage portion.

6. A 2-cycle engine as claimed in claim 2, wherein said first transfer passage portion comprises a pair of branches which open into said second transfer passage portion so as to oppose to each other.

7. A 2-cycle engine as claimed in claim 1, wherein said fuel feed means comprises a fuel reservoir, a fuel pump having a fuel pumping chamber connected to said fuel reservoir, and a fuel injection port connected to said fuel pumping chamber and opening into said crank room, said fuel pump being operatively connected to said choke means for directly feeding the fuel into said crank room when the closing operation of the choke valve of said choke means is carried out.

8. A 2-cycle engine as claimed in claim 7, wherein said fuel injection port is directed to a bottom face of said piston.

9. A 2-cycle engine as claimed in claim 7, wherein said fuel injection port is directed to the center of said crank room.

10. A 2-cycle engine as claimed in claim 7, wherein said fuel pump comprises:

a reciprocally movable piston defining said fuel pumping chamber and mechanically connected to said check valve;

a first check valve arranged in a first fuel passage communicating said fuel pumping chamber with said reservoir, and;

a second check valve arranged in a second fuel passage communicating said fuel pumping chamber with said fuel injection port.

11. A 2-cycle engine as claimed in claim 10, wherein a restricting member is inserted into said first fuel passage.

12. A 2-cycle engine as claimed in claim 11, wherein said restricting member is made of sintered metal.

13. A 2-cycle engine as claimed in claim 10, wherein said fuel feed means further comprises a diaphragm apparatus having a control rod engageable with said choke valve for actuating said control rod in response to the production of a vacuum within said intake passage to return said check valve to its full open position.

14. A 2-cycle engine as claimed in claim 13, wherein said diaphragm apparatus comprises a diaphragm vacuum chamber, a vacuum accumulation chamber, and an auxiliary chamber connected to said intake passage, said diaphragm vacuum chamber being connected to said vacuum accumulation chamber via a restricted opening, said vacuum accumulation chamber being connected to said auxiliary chamber via a restricted opening and a check valve.

15. A 2-cycle engine as claimed in claim 13, wherein said diaphragm apparatus comprises a diaphragm vacuum chamber, and an auxiliary chamber connected to said intake passage, said diaphragm vacuum chamber being connected to said auxiliary chamber via a restricted opening and a check valve, a restricting member being inserted into said first fuel passage.

16. A 2-cycle engine as claimed in claim 15, wherein said restricting member is made of sintered metal.

* * * * *

UNITED STATES PATENT AND TRADEMARK OFFICE

CERTIFICATE OF CORRECTION

PATENT NO. : 4,204,489

DATED : May 27, 1980

INVENTOR(S) : Sigeru ONISHI

It is certified that error appears in the above-identified patent and that said Letters Patent are hereby corrected as shown below:

Column 9, line 10, cancel "to", second occurrence.

Signed and Sealed this

*Twenty-second* Day of *July 1980*

[SEAL]

*Attest:*

SIDNEY A. DIAMOND

*Attesting Officer*

*Commissioner of Patents and Trademarks*